US010134243B2

(12) United States Patent
Nakamura

(10) Patent No.: US 10,134,243 B2
(45) Date of Patent: Nov. 20, 2018

(54) GAMING MACHINE, GAMING METHOD, AND RECORDING MEDIUM

(71) Applicant: Konami Gaming, Incorporated, Las Vegas, NV (US)

(72) Inventor: Daisuke Nakamura, Zama (JP)

(73) Assignee: Konami Gaming, Incorporated, Las Vegas, NV (US)

( * ) Notice: Subject to any disclaimer, the term of this patent is extended or adjusted under 35 U.S.C. 154(b) by 5 days.

(21) Appl. No.: 15/120,494

(22) PCT Filed: Feb. 20, 2015

(86) PCT No.: PCT/JP2015/054814
§ 371 (c)(1),
(2) Date: Aug. 19, 2016

(87) PCT Pub. No.: WO2015/125925
PCT Pub. Date: Aug. 27, 2015

(65) Prior Publication Data

US 2017/0032625 A1 Feb. 2, 2017

(30) Foreign Application Priority Data

Feb. 20, 2014 (JP) ..... 2014-031001

(51) Int. Cl.
*G07F 17/32* (2006.01)
*G07F 17/34* (2006.01)

(52) U.S. Cl.
CPC ..... *G07F 17/34* (2013.01); *G07F 17/32* (2013.01); *G07F 17/3213* (2013.01); (Continued)

(58) Field of Classification Search
None
See application file for complete search history.

(56) References Cited

U.S. PATENT DOCUMENTS 6,287,194 B1 * 9/2001 Okada ..... G07F 17/32 273/139
2006/0183530 A1 8/2006 Ellis
2014/0057694 A1 * 2/2014 Watkins ..... G07F 17/32 463/20

FOREIGN PATENT DOCUMENTS

JP 2004041246 A 2/2004
JP 2011056078 A 3/2011
(Continued)

OTHER PUBLICATIONS

International Search Report (PCT/JP2015/054814); dated May 19, 2015.
(Continued)

*Primary Examiner* — Damon Pierce
(74) *Attorney, Agent, or Firm* — Howard & Howard Attorneys PLLC

(57) ABSTRACT

A gaming machine providing a game that spins a plurality of reels with each reel including a plurality of symbols and thereafter stops the reels, determines a win based on arrangement of the symbols after stop, and provides an award in accordance with a win result. The gaming machine includes a display unit configured to display the game, and a controller configured to determine contents of the game to be displayed on the display unit. The controller determines application of a special event when a predetermined condition is satisfied, and determines a timing to apply the special event based on an award acquired by application of the special event.

16 Claims, 13 Drawing Sheets

(a)

| WINNING RATIO | PROBABILITY OF APPLYING SPECIAL EVENT DURING REEL SPIN | PROBABILITY OF APPLYING SPECIAL EVENT AFTER REEL SPIN IS STOPPED |
|---|---|---|
| LESS THAN 5 TIMES | 80% | 20% |
| EQUAL TO OR MORE THAN 5 TIMES AND LESS THAN 10 TIMES | 60% | 40% |
| EQUAL TO OR MORE THAN 10 TIMES AND LESS THAN 20 TIMES | 40% | 60% |
| EQUAL TO OR MORE THAN 20 TIMES | 20% | 80% |

(b)

| CREDIT SUM TO BE WON | PROBABILITY OF APPLYING SPECIAL EVENT DURING REEL SPIN | PROBABILITY OF APPLYING SPECIAL EVENT AFTER REEL SPIN IS STOPPED |
|---|---|---|
| LESS THAN 2000 | 80% | 20% |
| EQUAL TO OR MORE THAN 2000 AND LESS THAN 5000 | 60% | 40% |
| EQUAL TO OR MORE THAN 5000 AND LESS THAN 10000 | 40% | 60% |
| EQUAL TO OR MORE THAN 10000 | 20% | 80% |

(52) U.S. Cl.
CPC ..... *G07F 17/3244* (2013.01); *G07F 17/3267* (2013.01); *G07F 17/3269* (2013.01)

(56) References Cited

FOREIGN PATENT DOCUMENTS

| | | | |
|---|---|---|---|
| JP | 2011-115389 | A | 6/2011 |
| JP | 2013-106682 | A | 6/2013 |
| JP | 2013-153873 | A | 8/2013 |
| JP | 2013-183808 | A | 9/2013 |

OTHER PUBLICATIONS

International Preliminary Report on Patentability and Written Opinion (PCT/JP2015/054814); dated Sep. 1, 2016.

* cited by examiner

*Fig.13*

(a)

| WINNING RATIO | PROBABILITY OF APPLYING SPECIAL EVENT DURING REEL SPIN | PROBABILITY OF APPLYING SPECIAL EVENT AFTER REEL SPIN IS STOPPED |
|---|---|---|
| LESS THAN 5 TIMES | 80% | 20% |
| EQUAL TO OR MORE THAN 5 TIMES AND LESS THAN 10 TIMES | 60% | 40% |
| EQUAL TO OR MORE THAN 10 TIMES AND LESS THAN 20 TIMES | 40% | 60% |
| EQUAL TO OR MORE THAN 20 TIMES | 20% | 80% |

(b)

| CREDIT SUM TO BE WON | PROBABILITY OF APPLYING SPECIAL EVENT DURING REEL SPIN | PROBABILITY OF APPLYING SPECIAL EVENT AFTER REEL SPIN IS STOPPED |
|---|---|---|
| LESS THAN 2000 | 80% | 20% |
| EQUAL TO OR MORE THAN 2000 AND LESS THAN 5000 | 60% | 40% |
| EQUAL TO OR MORE THAN 5000 AND LESS THAN 10000 | 40% | 60% |
| EQUAL TO OR MORE THAN 10000 | 20% | 80% |

GAMING MACHINE, GAMING METHOD, AND RECORDING MEDIUM

CROSS REFERENCE TO RELATED APPLICATION

This application is a national stage application of PCT/JP2015/054814, filed Feb. 20, 2015, which claims priority to Japanese Patent Application No. 2014-031001, filed Feb. 20, 2014, the disclosures of which are hereby incorporated by reference in their entirety.

TECHNICAL FIELD

The present invention relates to a gaming machine, a gaming method, and a recording medium.

BACKGROUND ART

Patent Literature 1 discloses a slot machine as a gaming machine. The slot machine spin-displays reels including a plurality of symbols and thereafter stop-displays the reels to determine whether or not a win is acquired as a function of arrangement of the symbols that are stop-displayed. Also, the slot machine applies a special event to provide the player with an opportunity to win a high-priced dividend, when a trigger condition is satisfied. The special event includes, for example, re-spinning some of the reels after stop-displayed, or replacing some of the stop-displayed symbols with wild symbols. Additionally, the slot machine applies a special event regardless of the trigger condition to secure the frequency of the special event with a fixed value or more being applied when a predetermined number of games with no special event continue.

CITATION LIST

Patent Literature

Patent Literature 1: US Patent Application Publication No. 2006/0183530

SUMMARY OF INVENTION

Technical Problem

However, the gaming machine according to Patent Literature 1 applies a predetermined special event in a case where the number of games to which no special event is applied becomes equal to or more than a predetermined number. For this reason, the player can easily expect the timing to apply a special event, and consequently may be tired of the games. In addition, Patent Literature 1 does not disclose any specific definition of the timing to apply a special event in one game. In the present field of art, there is demand for a gaming machine, a gaming method, and a recording medium that effectively applies a special event.

Solution to Problem

A gaming machine according to an aspect of the present invention is a gaming machine providing a game that spins a plurality of reels with each reel including a plurality of symbols and thereafter stops the reels, determines a win based on arrangement of the symbols after stop, and provides an award in accordance with a win result. The gaming machine includes a display unit configured to display the game and a controller configured to determine contents of the game to be displayed on the display unit. The controller determines application of a special event when a predetermined condition is satisfied, and determines a timing to apply the special event based on an award acquired by application of the special event.

The gaming machine determines a timing to apply the special event based on an award acquired by application of the special event; therefore, it prevents uniformity of the timing to apply the special event. Accordingly, the gaming machine can provide the special event at a timing that is unexpected to the player. Consequently, the special event can be effectively applied.

In one embodiment, the controller may determine whether the special event is to be applied before stop of reel spin, or after stop of the reel spin, based on the award acquired by application of the special event.

As described above, the special event can be applied either before or after stop of the reel spin; therefore, for example, the gaming machine can apply an unexpected special event after stop of the reel spin to the player who is not aware of existence of the special event, and the gaming machine also provides the player who is aware of existence of the special event with expectations for application of the special event after stop of the reel spin, even when no special event is applied before stop of the reel spin. Accordingly, the gaming machine can effectively apply the special event.

In one embodiment, the controller may apply the special event before stop of reel spin when a dividend serving as the award acquired by application of the special event is equal to or lower than a predetermined amount, and may apply the special event after stop of the reel spin when the dividend serving as the award acquired by application of the special event is higher than the predetermined amount.

With such a configuration, in case when no high dividend is generated even the special event is applied, because the gaming machine as described above can apply the special event before stop of the reel spin to provide a state advantageous to the player, the gaming machine enables the player to have expectations for a result of the game until the reel spin is stopped. In addition, when no high dividend is generated even when the special event is applied, the gaming machine can prevent causing a situation in which application of the special event after stopping the reel spin provides excessive expectations to the player and thereafter giving a strong disappointment to the player due to a failure in acquisition of the expected dividend as a result by not applying the special event after stopping the reel spin. In addition, when the dividend at the time when the special event is applied is high, by applying the special event after stopping the reel spin, the gaming machine is able to provide a high dividend with the player's recognition of the symbol arrangement after stopping the reel spin and the symbol arrangement after applying the special event which enhances the player's surprise and satisfaction.

In one embodiment, the controller may apply the special event before reel spin is stopped when a dividend serving as the award acquired by application of the special event is equal to or less than the dividend serving as an award acquired in a case where no special event is applied, and may apply the special event after stopping the reel spin when the dividend serving as the award acquired by application of the special event is larger than the dividend serving as the award acquired in a case where no special event is applied.

With such a configuration, when the dividend is not increased even the special event is applied, the special event is applied before stopping the reel spin to provide a state advantageous to the player so that the gaming machine enables the player to have expectations for a result of the game until the reel spin is stopped. In addition, when the dividend is not increased even when the special event is applied, the gaming machine can prevent causing a situation in which application of the special event after stopping the reel spin provides the player with excessive expectations and thereafter giving a strong disappointment to the player due to a failure in acquisition of the expected dividend as a result by not applying the special event after stopping the reel spin. In addition, when the dividend at the time when the special event is applied is larger than the dividend at the time when no special event is applied, by applying the special event after stopping the reel spin, the player is able to acquire a dividend with the recognition of the symbol arrangement after the reel spin is stopped and the symbol arrangement after the special event application which enhances the player's surprise and satisfaction.

In one embodiment, the controller may apply the special event before reel spin is stopped when a difference between a dividend serving as the award acquired by application of the special event and the dividend serving as the award acquired in a case where no special event is applied is equal to or less than a predetermined amount, and may apply the special event after the reel spin is stopped when the difference between the dividend serving as the award acquired by application of the special event and the dividend serving as the award acquired in a case where no special event is applied is larger than the predetermined amount.

With such a configuration, the timing to apply the special event can be changed in accordance with the difference in dividend between before and after application of the special event; therefore, the gaming machine can more effectively apply the special event.

A gaming method according to another aspect of the present invention is a gaming method by which a display unit displays a game that spins a plurality of reels with each reel including a plurality of symbols and thereafter stops the reels to determine a win based on arrangement of the symbols after the stop, and a controller determines contents of the game to be displayed on the display unit and provides an award in accordance with the determined contents. The method includes steps of: determining, by the controller, application of a special event exerting influence on the award when a predetermined condition is satisfied; and determining, by the controller, a timing to apply the special event based on an award to be acquired by applying the special event.

The gaming method determines the timing to apply the special event based on the award to be acquired by applying the special event; therefore, the gaming method can prevent uniformity of the timing to apply the special event. Accordingly, the gaming method can provide the special event at a timing that is unexpected to the player, and can effectively apply the special event.

A recording medium according to another aspect of the present invention is a computer-readable recording medium recording a program to cause one or a plurality of computers to implement a function of providing a player with a game that spins a plurality of reels with each reel include a plurality of symbols and thereafter stops the reels, determine a win based on arrangement of symbols after the stop, and provides an award in accordance with a win result, as a function. The program causes the one or plurality of computers to function as a controller determining contents of the game to be displayed on a display unit. The controller is configured to determine application of a special event which exerting influence on the award when a predetermined condition is satisfied, and determine a timing to apply the special event based on an award to be acquired by applying the special event.

The recording medium can determine the timing to apply the special event based on the award to be acquired by applying the special event; therefore, the recording medium can prevent uniformity of the timing to apply the special event. Accordingly, the recording medium can provide the special event at a timing that is unexpected to the player, and can effectively apply the special event.

Advantageous Effects of Invention

The present invention provides a gaming machine, a gaming method, and a recording medium that can effectively apply the special event.

BRIEF DESCRIPTION OF DRAWINGS

FIG. 13 illustrates an example of tables illustrating probabilities of timing to apply the special event.

DESCRIPTION OF EMBODIMENTS

Figure 1:
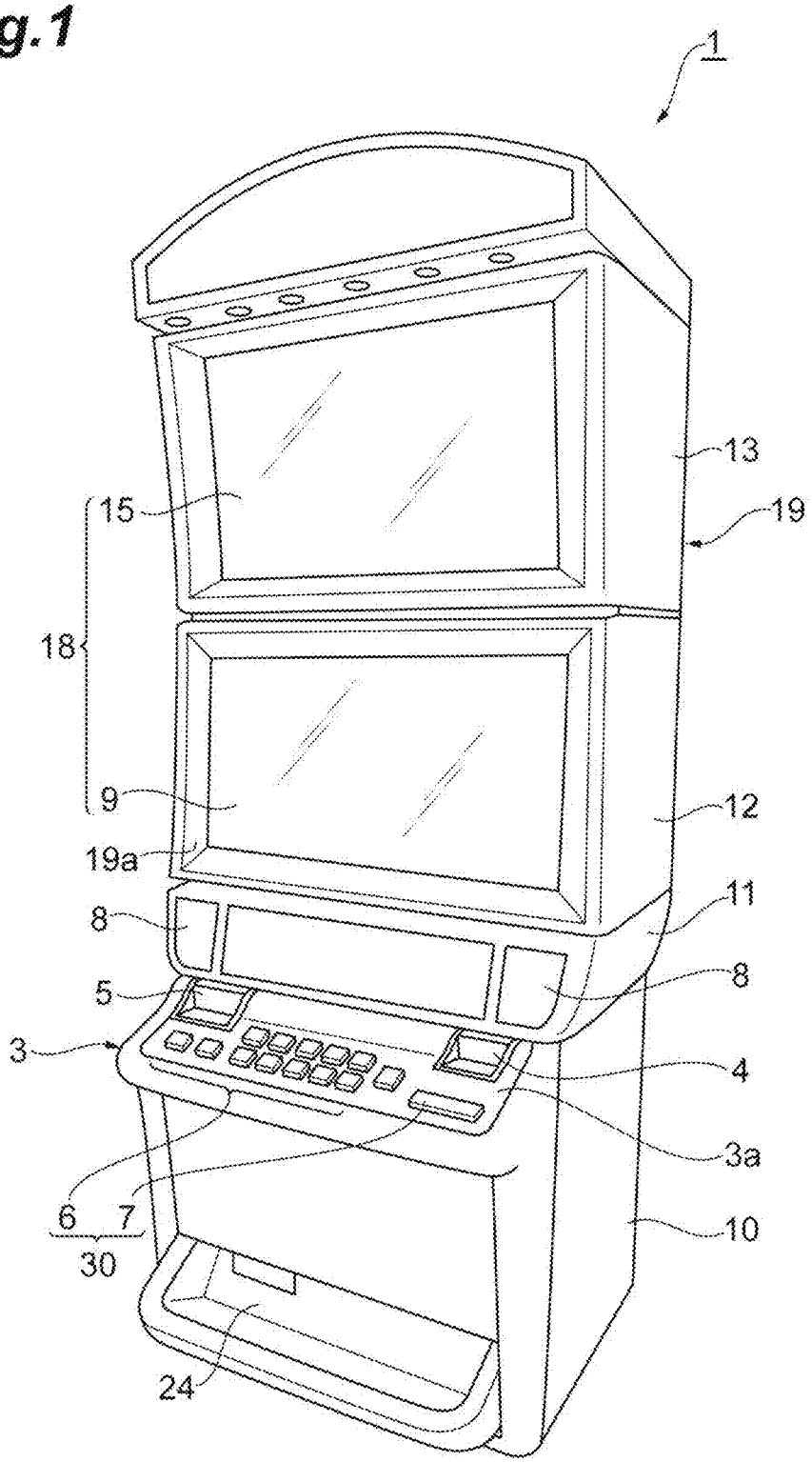
FIG. 1 is a perspective view of a gaming machine according to an embodiment.

The following is an explanation of an embodiment of the present invention with reference to attached drawings. In the drawings, the identical or corresponding elements are denoted by the same reference numeral, and repeated explanation will be omitted.

A gaming machine 1 according to the present embodiment is a machine that provides a game in compensation for a wager and provides an award according to the game result, such as a slot machine, a poker machine, a keno machine, a bingo machine, a pachinko machine, and a pachinko-slot machine, which provide the player with games in casinos. Examples of the wager include tangibles such as metallic currency, bills, coins, medals, and tickets, or concepts including electric data with values equivalent to the tangibles. When the wager as described above is deposited into the gaming machine 1, the wager is converted into a number of credit serving as a consumption unit and accumulated to be used to provide the player with a game by consuming the accumulated credit. Further, examples of the award include a dividend of credit for a win result, provision of special games such as free games, bonus games, and progressive games, and provision of a jackpot or a progressive jackpot prize. The following explanation illustrates an example of the case where the gaming machine 1 is a slot machine that includes reels with each of the reels includes a plurality of symbols, spins the reels and thereafter stops the reels, determines whether or not a win is acquired in accordance with the symbols that are displayed when the reels are stopped, and provides a dividend serving as an award according to a win result.

FIG. 1 is a perspective view of the gaming machine 1 according to the embodiment. As illustrated in FIG. 1, the gaming machine 1 includes a vertical housing 19 extending in the vertical direction. A front surface 19*a* of the housing 19 is provided with a display unit (display unit) 18. The display unit 18 has a function of displaying contents of the game. The display unit 18 includes a lower display device 9 and an upper display device 15.

The lower display device 9 and the upper display device 15 display graphics or images relating to the contents of the game. The lower display device 9 is provided in a box 12. An upper box 13 is provided above the box 12. A front surface of the upper box 13 is provided with the upper display device 15 as described above.

A control panel 3 is provided under the display unit 18. The control panel 3 is provided in a bottom cabinet 10 provided under the box 12. A surface 3*a* of the control panel 3 is provided with an inserting port 4, an output port 5, and an operating unit 30. The inserting port 4 receives a wager that is deposited by the player as a compensation for execution of the game. Coins or bills are used as the wager for example. A voucher ticket, which is a medium with printed information of the credit accumulated in the gaming machine 1, is outputted from the output port 5 in response to an operation of a payout button described later. The inserting port 4 or the output port 5 may further be configured to be capable of reading credit information printed on the medium. In this case, the gaming machine 1 may have a structure of accumulating credit in the gaming machine 1 based on the read credit information.

The operating unit 30 receives various instructions from a player for the gaming machine 1. The operating unit 30 includes, for example, a spin button 7 and a plurality of buttons 6. The spin button 7 receives an instruction to start the game (to start spin of the reels). The buttons 6 includes, for example, a bet button group, a line designating button group, a max bet button, and/or a payout button. The bet button group receives an operation to designate the credit by a predetermined unit amount that is bet by the player. The line designating button group receives an operation to issue an instruction to designate the line (hereinafter referred to as "effective line") to be designated as a target for a win determination. The max bet button receives an operation to issue an instruction to bet the maximum credit that can be bet at one time. The payout button receives an operation to issue an instruction to pay out. A payout tray 24 is provided to pay out the wager under the control panel 3. The payout tray 24 is provided in the bottom cabinet 10. When the payout button is operated, the gaming machine 1 may output information of the accumulated credit from the output port 5 or pay out the wager from the payout tray 24, and either of which is selected according to the setting of the gaming machine 1. The gaming machine 1 may be configured to select one of them in accordance with the player's designation.

A lower box 11 is disposed between the box 12 and the bottom cabinet 10. A front surface of the lower box 11 is provided with a plurality of speakers 8. The plurality of speakers 8 may output sound, for example, in accordance with progress of the game. The speakers 8 may also output sound even when the gaming machine 1 is not providing a game.

Figure 2:
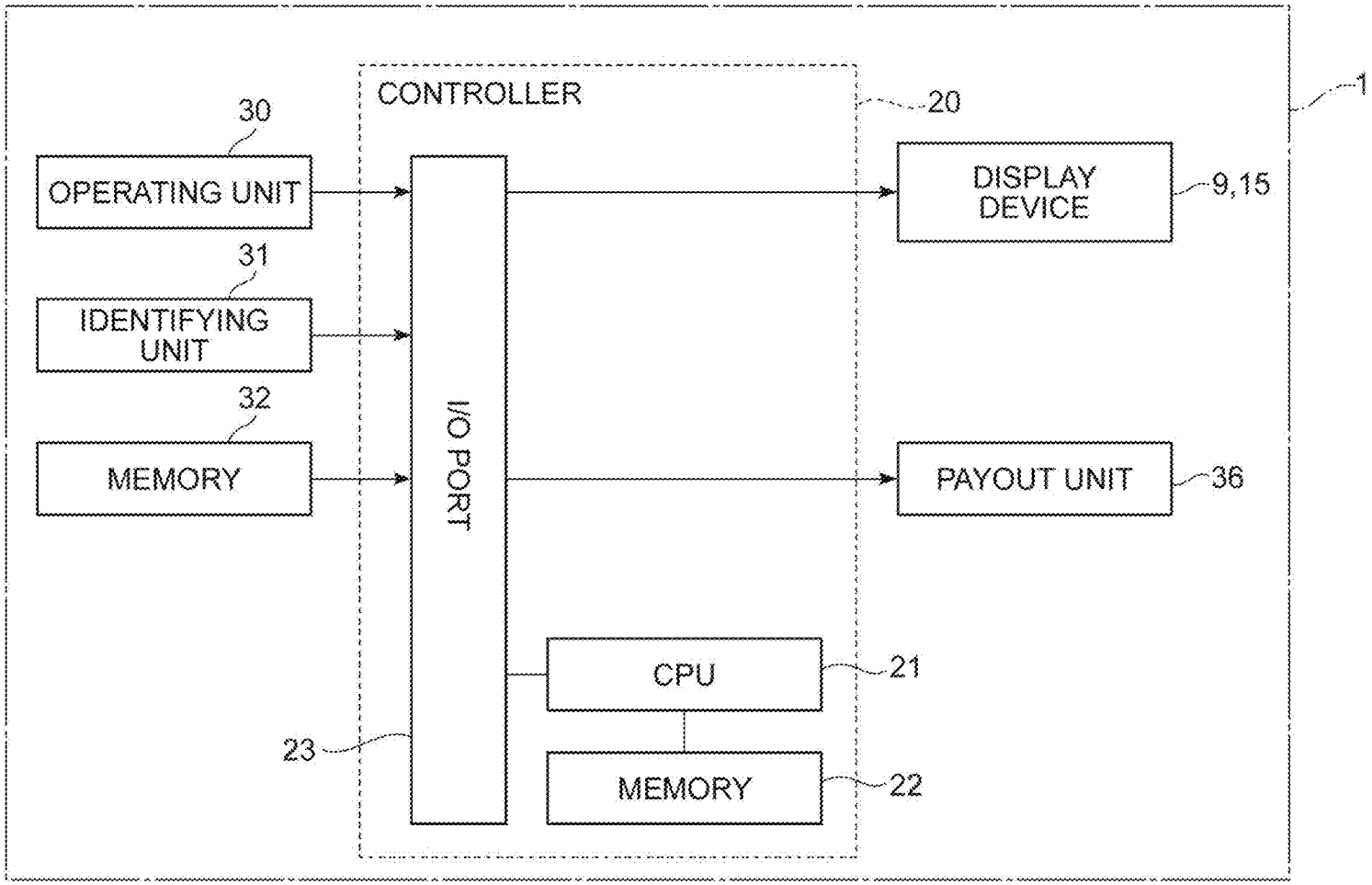
FIG. 2 is a block diagram of a control system in the gaming machine in FIG. 1.

FIG. 2 illustrates an outline of a control system in the gaming machine 1. The gaming machine 1 includes a controller 20. The controller 20 is configured as a computer unit including a central processing unit (hereinafter abbreviated to "CPU") 21, and a memory 22 which can be referred by the CPU 21. The memory 22 may include a magnetic or optical storage medium, or a nonvolatile storage medium such as an EEPROM. The memory 22 records a game program necessary for execution of a game and game data to be referred by the game program. The CPU 21 reads and executes the game program to determine the contents of the game, and progresses the slot game in a predetermined procedure. Such controller 20 as described above may be configured to be stored in, for example, the bottom cabinet 10 of the housing 19. The controller may be separated from the housing 19, and provided on a network such as a local area network (LAN) or a wide area network (WAN). The following explains operations of the controller 20 as operations of the CPU 21.

The CPU 21 is connected with the operating unit 30 and an identifying unit 31 via an input/output (I/O) port 23. The operating unit 30 receives a player's instruction and outputs a signal corresponding to the player's instruction to the CPU 21. The identifying unit 31 identifies the wager (such as coins, bills, or tickets, and the like.) inserted from the inserting port 4 and outputs a signal corresponding to the identified amount to the CPU 21.

The CPU 21 determines the contents of the game based on the player's instruction and the bet credit or the like. The CPU 21 is also connected with the lower display device 9, the upper display device 15, the reels 2, and a payout unit 36 via the I/O port 23. The CPU 21 operates at least one of the lower display device 9 and the upper display device 15 in accordance with the determined contents of the game to display the contents of the game in the display area. The mentioned-display area is a display panel portion of the lower display device 9 or the upper display device 15. The CPU 21 performs controlling virtual reels spins, described later, in accordance with the determined game contents. The CPU 21 causes the payout unit 36 to manage payout of the wager to the payout tray 24 and causes the output port 5 to manage printing and outputting information of the accumulated credit on a medium. The controller 20 is also properly connected with other devices necessary for execution of the slot game, but illustrations of the other devices are omitted.

Figure 3:
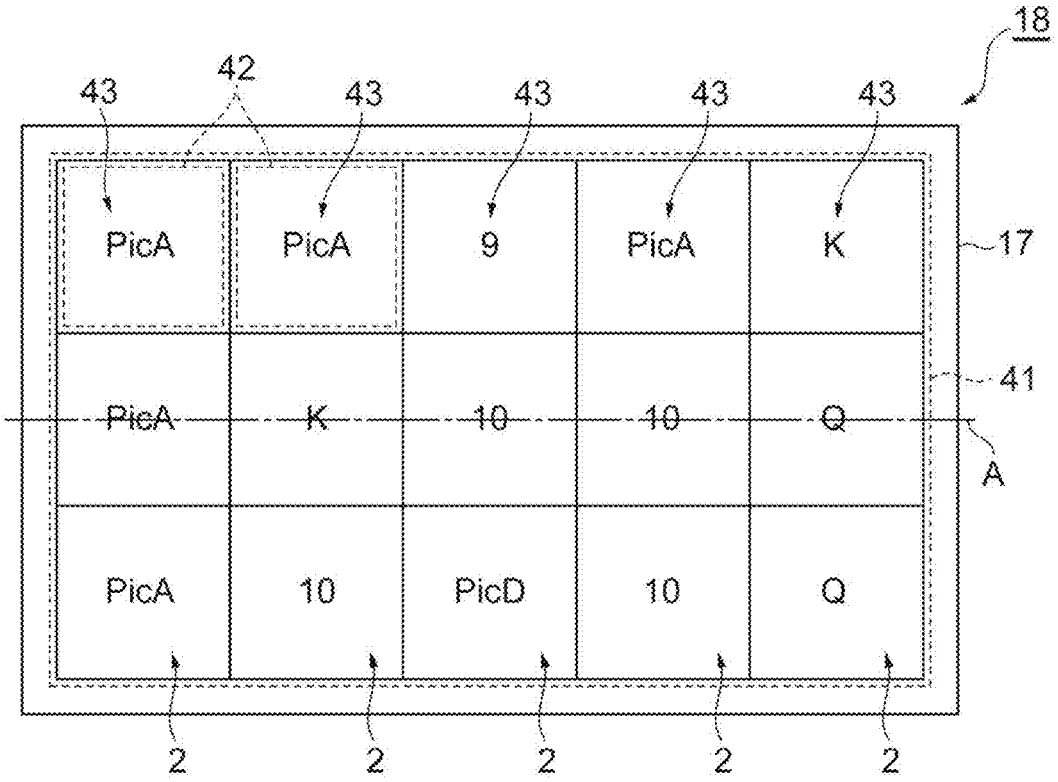
FIG. 3 illustrates an example of a picture of a slot game.

FIG. 3 illustrates an example of a slot game display displayed on the display unit 18 in accordance with the control of the CPU 21. As illustrated in FIG. 3, a game display 40 is displayed in a display area 17. A plurality of reels 2 are displayed in the game display 40. The reels 2 are video reels that are virtually configured with a plurality of symbols arranged therein, wherein the symbols are selected from, for example, "9", "10", "J", "Q", "K", "A", "Pic-A", "Pic-B", "Pic-C", "Pic-D", and "Pic-E". The game display 40 is provided with a symbol region 41 to display the symbols of the reels 2. In this example, in the symbol region 41, a plurality of cells 42 serving as symbol stop positions are defined to form a matrix including three rows in the vertical direction and five columns in the horizontal direction. In the following explanation, the horizontal direction of the game display 40 may be referred to as row direction, and the vertical direction may be referred to as column direction. In the symbol region 41, the symbols of the reels 2 are displayed to move (scroll) in the column direction in a predetermined spin period and the scroll of the symbols are stopped and displayed in the predetermined stop period. Borderlines of the cells 42 may be displayed such that they can be visually recognized by the player on the display unit 18 or display thereof may be omitted. In other words, it is suffice if the cells 42 are logically or conceptually defined as symbol stop positions inside the gaming machine 1 and borderlines of the cells 42 are not necessarily to be visually recognizable.

The effective line is a line that designates a plurality of cells 42 to be served as targets of a win determination in the slot game and is set to extend over the reels 2. The effective line may be properly set by the player operating the line designating button group of the operating unit 30, or the effective line may be properly set by operating the bet button. An example of the effective line that can be set is a horizontal line A that connects all the cells 42 located in the vertical center of the symbol region 41. Some other examples are the effective line being set to a line extending in a diagonal direction of the symbol region 41, or a line having a V shape or an inverted V shape in the symbol region 41. When the player operates the bet button group to designate the number of units to be bet in a slot game and selects the effective line with the line designating button group, the CPU 21 recognizes those selection contents. Thereafter, when the player operates the spin button 7, the CPU 21 moves (scrolls) each of the symbols 43 to the column direction in the symbol region 41 to stop the scroll of the symbols 43 in a predetermined stop period such that one symbol 43 appears in one cell 42. When the symbols 43 are stopped, a winning pattern is formed when the designs of the symbols 43 displayed in the cells 42 on the effective line match or forming a predetermined relation. In the following explanation, a win determination using the effective line is referred to as line determination.

Further, a determination method other than the line determination described above may be adopted. For example, a part or the whole of the symbol region 41 may be designated as a determination region, to determine acquisition of a win when a predetermined number of specific symbols exist in the determination region. As another example, acquisition of a win may be also determined when specific symbols are successively displayed in a predetermined number of successive reels from the reels of the left to the right ends in the symbol region 41. Such a win determination is referred to as a scatter determination in the following explanation.

The symbols 43 are predetermined as virtual reel strips serving as symbol arrangements that are virtually configured to correspond to the respective reels 2, and recorded in the memory 22 as a part of the game data. The CPU 21 refers to the data recorded in the memory 22 to control display of the reels 2 in the game display 40. The data stored in the memory 22 may be stored in a memory 32 that is readable by the controller 20.

Figure 4:
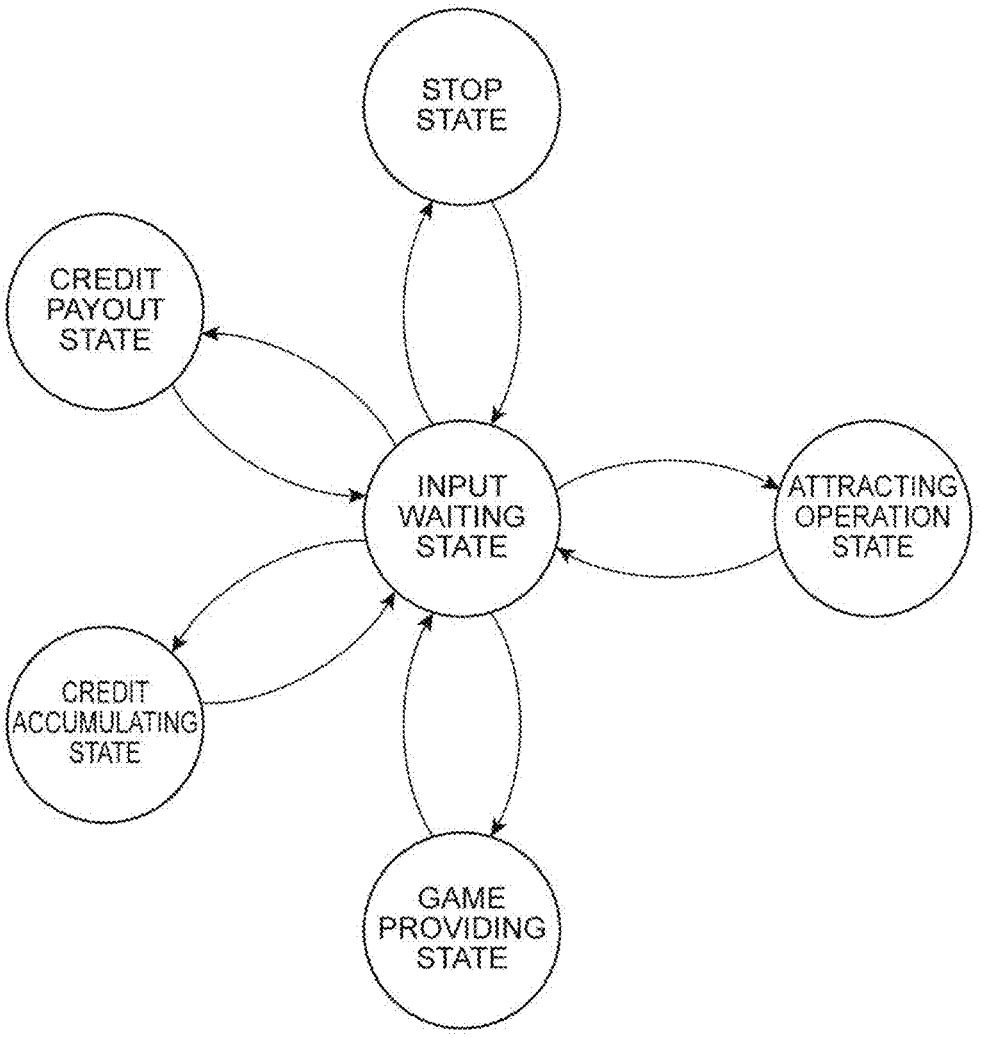
FIG. 4 is a state transition diagram of the gaming machine of FIG. 1.

The following is an explanation of operations of the gaming machine 11 according to the present embodiment, with reference to FIG. 4. FIG. 4 is a state transition diagram of the gaming machine 1 configured as described above according to the present embodiment. As illustrated in FIG. 4, the gaming machine 1 changes to the states including a stop state, an input waiting state, a credit payout state, a credit accumulating state, an attracting operation state, and a game providing state. The following is an explanation of these states.

The stop state indicates that the gaming machine 1 is not being activated. The gaming machine 1 in the stop state is activated and initialized when a certain activating operation is received, a predetermined program is executed by the controller 20 and a game display is displayed on the display unit 18, and then the gaming machine 1 changes its state to the input waiting state.

As for the gaming machine 1 in the input waiting state, when a bill/ticket identifying unit 55 identifies a bill or a ticket, the gaming machine 1 changes to the credit accumulating state to accumulate corresponding credit information in the gaming machine 1, and returns to the input waiting state when accumulation of the credit ends. When the gaming machine 1 in the input waiting state receives an operation of the payout button in a state where credit information is accumulated, the gaming machine 1 changes its state to the credit payout state to perform a payout process of the accumulated credit and output a ticket including printed information corresponding to the credit payout processing from a printer unit 56, and reset the credit accumulated in the gaming machine 1 to zero. The gaming machine 1 that has finished the processing returns to the input waiting state.

When the gaming machine 1 in the input waiting state is not operated for a predetermined time, the state changes to the attracting operation state to display an attraction display on the display unit 18. When the gaming machine 1 in the attracting operation state receives some operation, it returns to the input waiting state. The attraction display is a display to appeal to customers in the casino for the existence of the gaming machine 1, and consist of predetermined images and/or animations.

The gaming machine 1 in the input waiting state sets the number of lines and the number of bets of the game by receiving an operation of the line selection button, the bet number selection button, or the max bet button in a state where the credit is accumulated inside, and receives an operation of the start button to reduce the credit amount by the amount obtained by multiplying the set number of lines and the credit amount and change to the game providing state. In the game providing state, the gaming machine 1 provides a game in accordance with the flowcharts illustrated in FIG. 5 and FIG. 6. The gaming machine 1 may also change to the game providing state in response to an operation of the bet number selection button or the max bet button.

Figure 5:
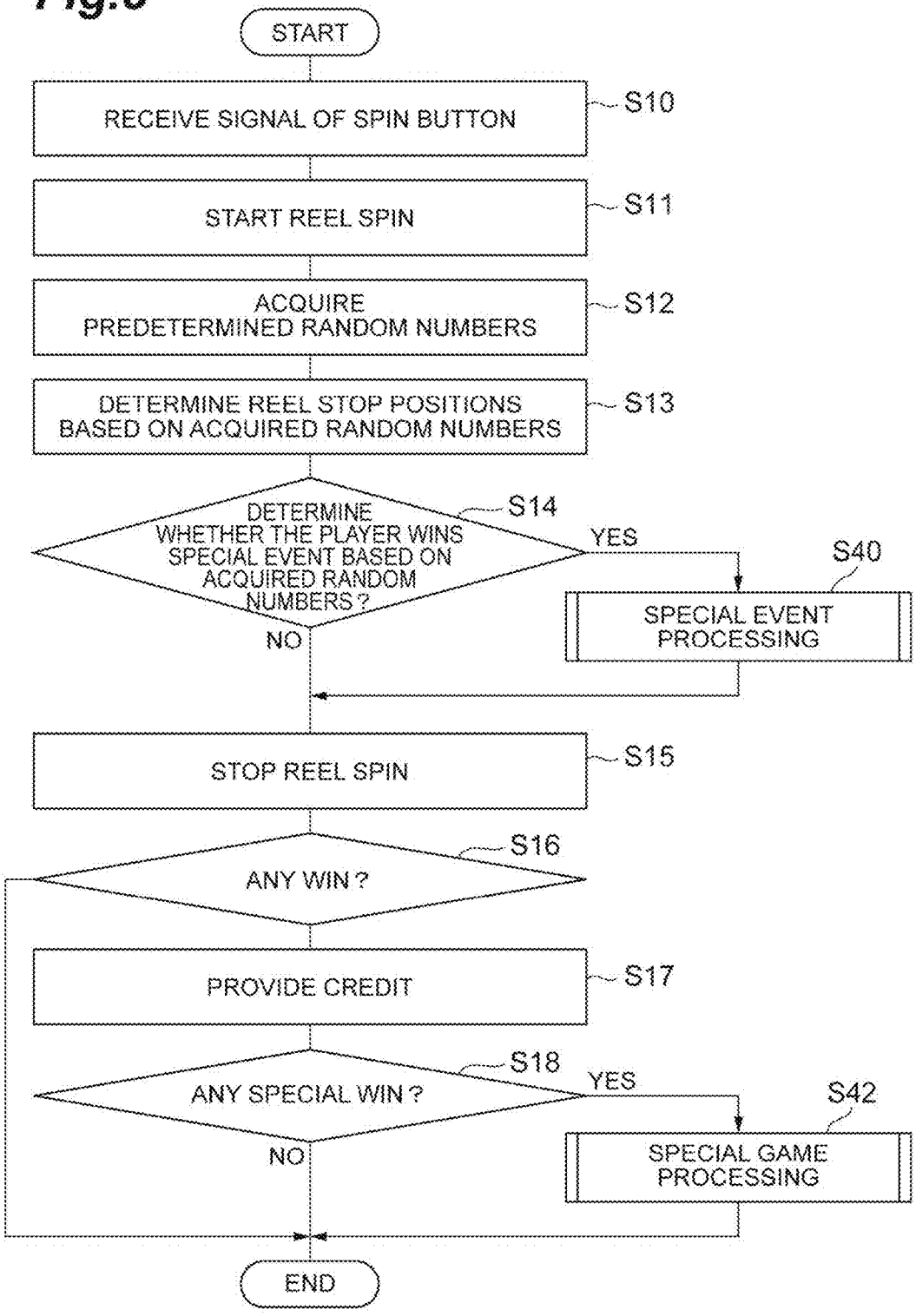
FIG. 5 is a flowchart illustrating operations in a normal game of the gaming machine of FIG. 1.
Figure 6:
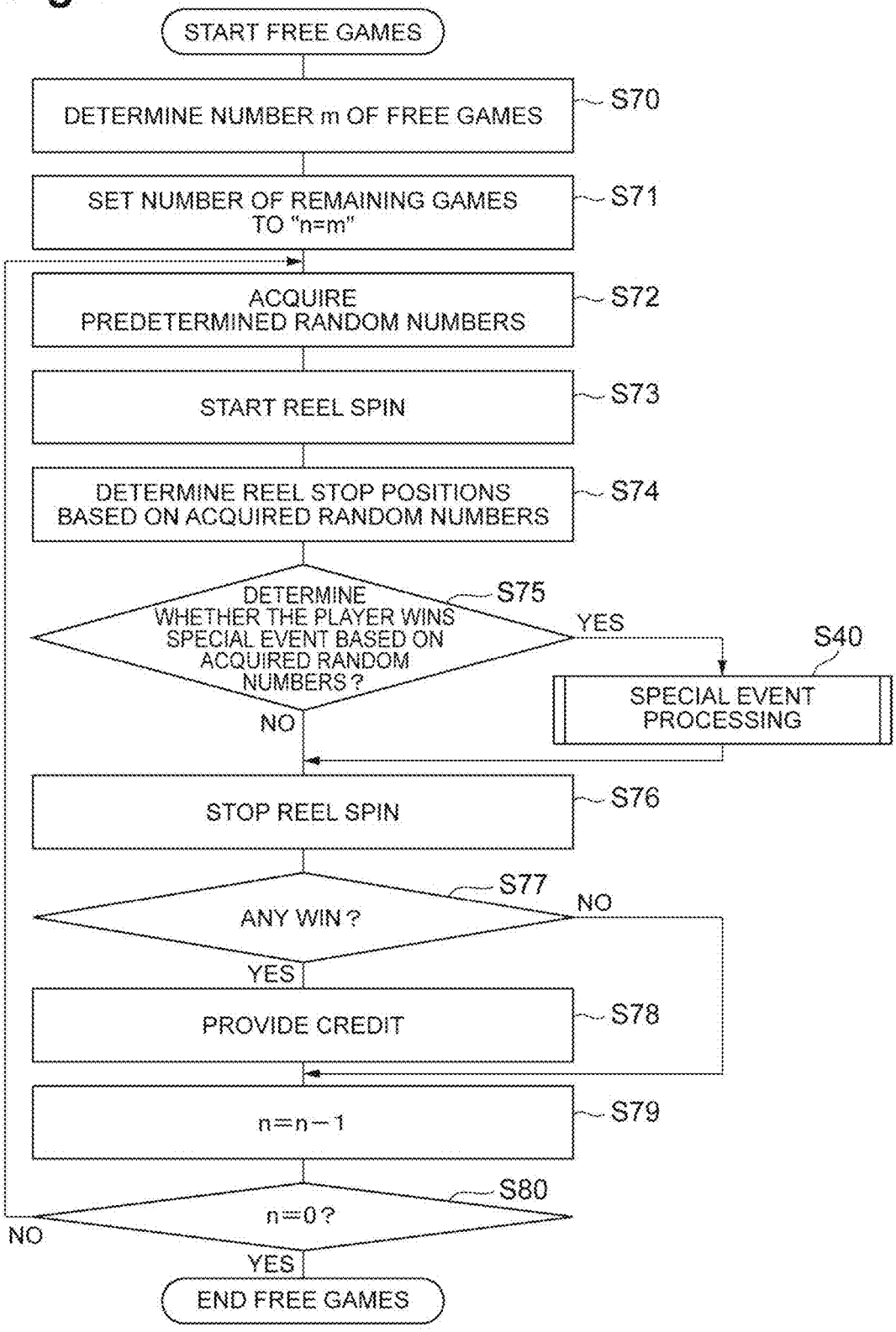
FIG. 6 is a flowchart illustrating operations in free games of the gaming machine of FIG. 1.

The following is an explanation of operations in the game providing state, as a method for controlling the gaming machine 1, by referring to the flowcharts illustrated in FIG. 5 and FIG. 6.

The gaming machine 1, which has received setting of the number of lines and the number of bets in the input waiting state, and then changed to the game providing state by receiving the operation of the start button, starts a normal game by controlling the upper display device 15 and the lower display device 9 by the controller 20.

The normal game proceeds in accordance with the flowchart of FIG. 5. First, in the processing at S10, the CPU 21 receives a signal of the spin button 7. Determination is repeated if a signal of the spin button 7 is not inputted, and the process proceeds to S11 if a signal of the spin button 7 is inputted. Further, the processing at S10 may proceed to S11 in response to a player's operation of the bet button as described above.

In the processing at S11, the CPU 21 starts displaying spin of the respective reels 2 in the symbol region 41 displayed in the game display 40 on the display unit 18. Subsequently, the process proceeds to S12 and the CPU 21 acquires a predetermined number of random numbers required for providing the game. The random numbers may be internally generated by the CPU 21, or may be acquired by the CPU 21 from a random number generator (not illustrated) that is installed separately in the gaming machine 1, the random numbers may also be acquired from a device, such as a server set up outside the gaming machine 1.

In the next processing at S13, the CPU 21 determines stop positions of the respective reels 2, based on the random numbers acquired at S12. For example, the CPU 21 is capable of using one random number for each of the reels 2 to determine a position of a virtual reel strip corresponding to the random number that is used in a predetermined table as the stop position.

Subsequently, in the processing at S14, the CPU 21 determines whether or not the player wins a special event based on the random numbers acquired at S12. The CPU 21, for example, determines that a special event application event (predetermined condition) would be satisfied when a result of a lottery drawing based on the random numbers is a win. The special event application condition is a condition to apply the special event. The special event will be described later. When the CPU 21 determines that the special event has not been won, the process proceeds to S15.

In the processing at S15, the CPU 21 stops the reels that are spin-displaying in the symbol region 41, based on the stop positions of the respective reels determined in the processing at S13. Subsequently, in the processing at S16, the CPU 21 determines whether or not a combination of the symbols 43 appearing in the cells 42 of the symbol region 41 form a predetermined winning pattern. When no winning pattern is formed, the operations of the normal game illustrated in FIG. 5 are terminated. On the other hand, when any winning pattern is formed, the process proceeds to S16. In the processing at S16, the CPU 21 calculates the prize amount corresponding to the formed winning pattern, and provides the player with credit that is equivalent to the calculated prize amount. The provided credit is accumulated in the gaming machine 1, and can be used as a bet in the next and succeeding slot games. When providing the credit ends, the process proceeds to S18.

In the processing at S18, the CPU 21 determines whether or not the combination of the symbols 43 appearing in the cells 42 of the symbol region 41 forms a predetermined bonus pattern (special win). The predetermined bonus pattern is a condition to apply a bonus game. When no bonus pattern is formed, the operations of the normal game illustrated in FIG. 5 end. In contrast, when any bonus pattern is formed in the processing at S18, a special game is provided in the processing at S42.

FIG. 6 is a flowchart illustrating details of an example of special game processing at S42. In this case, the present embodiment illustrates the case of providing free games to allow the player to play a predetermined number of games equal to normal games without credit consumption as the special games. In the processing, the number m of free games to be provided is determined at S70 first. Here, the number of free games is a set number, with one game being from when a reel spin starts to when it ends and a determination is made as to whether or not any winning pattern is formed (in a case where any winning pattern is formed, further to provision of credit). The CPU 21 may automatically execute a plurality of free games without waiting for a player's input, or may wait for a player's operation after finishing one game and then start the next free game. Further, the number m of free games may be determined in accordance with a combination of the symbols 43 determined to be formed in the cells 42 of the symbol region 41 in the processing at S18. After the determination, the process proceeds to S71 and m is set as the value n of the remaining games of the free games.

The processing from S72 to S78 corresponds to the processing from S12 to S17 in the operations of the normal game as illustrated in FIG. 5. Specifically, a display of the respective reels 2 spinning in the symbol region 41 is started at S72, a predetermined number of random numbers are acquired at S73, and the stop positions of the respective reels 2 are determined at S74. Subsequently, whether or not the player won a special event is determined at S75, the special event in the processing is provided at S40 in the same manner as the normal game if the special event was won, and the reel spin is stopped in the processing at S76 if the special event was not won.

After the special event is executed in the processing at S40, or after the reel spin is stopped in the processing at S76, it is determined whether or not a win is acquired in the processing at S77, a predetermined credit is provided in the processing at S78 if a win is acquired. If it is determined that no win is acquired in the processing at S77, or after credit is provided in the processing at S78, the number n of the remaining games is decremented to n−1 in the processing at S79. Subsequently, whether or not n=0 is determined in the processing at S80, the next and succeeding steps are repeated if the determination is made that n=0, and the free game providing processing is ended if the determination that n=0 is not made, and the process returns to the flowchart of FIG. 5 to end a series of operations.

Figure 7:
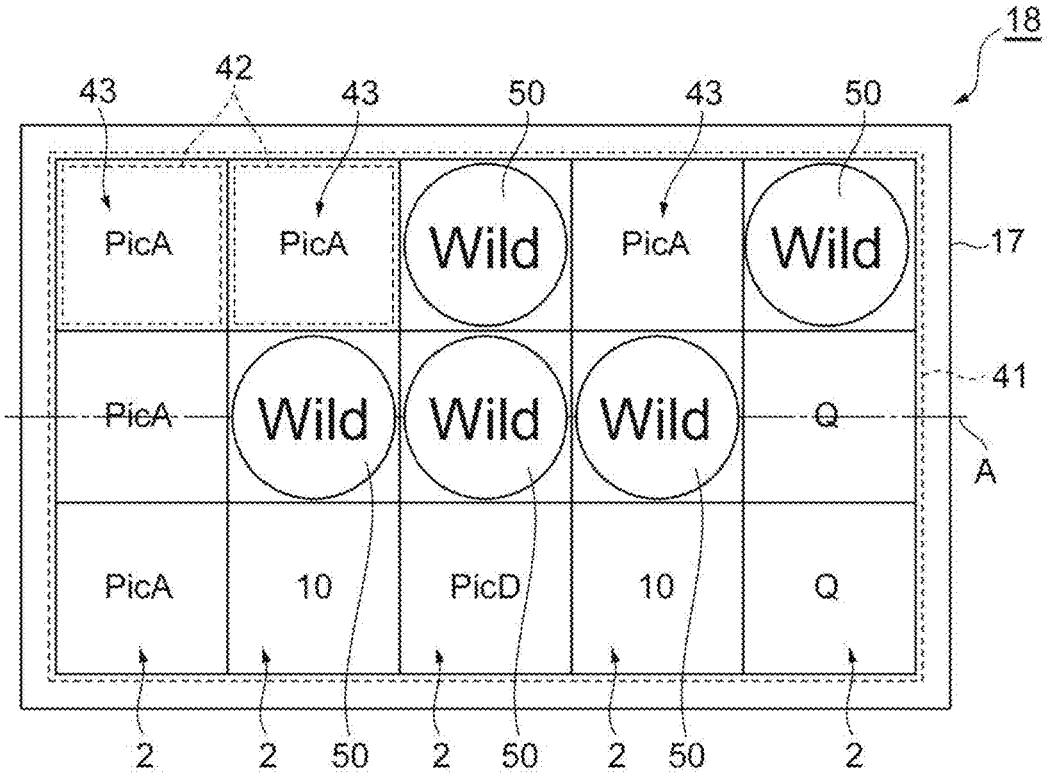
FIG. 7 illustrates an example of a display unit when a special event is applied.

The following is a detailed explanation of the processing in S40 described above. In the processing at S40, the CPU 21 executes a special event. The special event is an event in a game which provides a situation advantageous to the player. Examples of the special event include an event to change symbols displayed in the predetermined cells 42 in the symbol region 41 to wild symbols that can be substituted for other symbols. FIG. 7 illustrates a display of an example in which the special event is applied to the symbol region 41 of the game display 40 illustrated in FIG. 3. In the example, the plurality of symbols 43 displayed in the cells 42 of FIG. 3 are changed to wild symbols 50. As illustrated in FIG. 7, a winning pattern can be easily formed by changing the symbols to wild symbols by the special event, and the player is provided with an advantageous situation having a high probability of winning a high-priced prize. Application of the special event, and the positions and the number of symbols to be changed to wild symbols may be determined at random or based on predetermined rules. For example, the positions and the number of the symbols to be changed may be determined in response to display of a predetermined symbol or a predetermined combination of symbols in the symbol region 41. Further, an example shows one symbol is changed to one wild symbol in FIG. 7, but a plurality of adjacent symbols may be changed to a large wild symbol, and a win determination can be configured to recognize each of the symbol positions including a wild symbol as an ordinary size. In addition, the visual expression of the process of changing the symbols to wild symbols is not limited and any expression may be properly used, such as a form in which a symbol is changed to a wild symbol by animation, a form in which a graphic of the wild symbol is superimposed and disposed on a graphic of the symbol, and a form in which the graphic of the wild symbol is moved onto and disposed on the graphic of the symbol.

Other examples of the special event include: an event in which the reels are re-spun after a win determination while some of the symbols displayed in the symbol region 41 are held; an event in which symbols displayed in the cells 42 are promoted to symbols with a higher value; an event in which a multiplier is applied to provide a multiple to the prize amount corresponding to a formed winning pattern; an event in which the multiple of the multiplier is increased; an event in which the determination line or the symbol region 41 is expanded to increase the number of subjected symbols for a win determination; and an event in which low valued symbols are replaced with high valued symbols. Further, the special event may be an event to change the virtual reels forming the reels to a configuration advantageous to the player, and an event to add a special reel including symbols advantageous to the player. In any case, no limitations exist for the application, the contents, and the visual expression of the special event, as described above.

Figure 8:
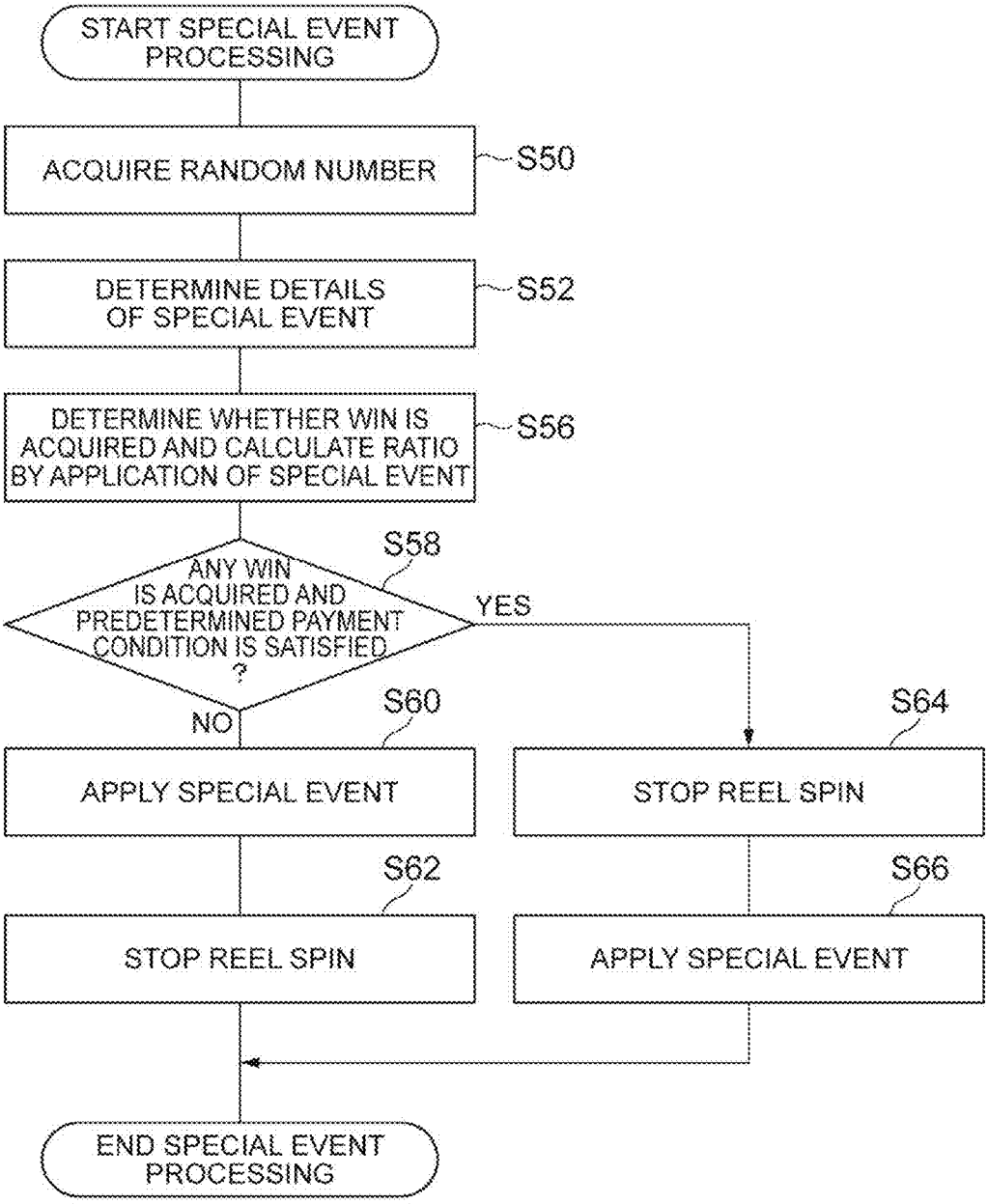
FIG. 8 is a flowchart illustrating operations of special event processing of the gaming machine of FIG. 1.

The following is an explanation of the outline of the special event processing. FIG. 8 is a flowchart illustrating operations to execute a special event by the CPU 21. The following explanation illustrates the case where the special event is an event to change at least one normal symbol in the plurality of reels 2 to a wild symbol as an example.

When the operations illustrated in FIG. 8 are started, the CPU 21 acquires a random number (S50) first. After the acquisition, the process proceeds to S52. In the processing at S52, the CPU 21 determines processing details of the special event using the acquired random number. The processing details of the special event are, for example, the disposed positions and the number of the wild symbols. The CPU 21 is capable of determining the processing details of the special event using the random number from a plurality of patterns prepared in advance. Further, when the patterns of the processing details of the special event include only one pattern, the processing at S50 and S52 may be omitted. After the processing details of the special event are determined, the process proceeds to S56.

In the processing at S56, the CPU 21 determines whether or not a combination of symbols acquired by application of the special event forms a predetermined winning pattern, based on the reel stop positions determined at S13 or S74 and the processing details of the special event determined at S52. When the CPU 21 determines that a winning pattern is formed when the special event is applied, the CPU 21 calculates as to what number times the bet number becomes the win dividend when the special event is applied. When the special event is used together with a multiplier, the CPU 21 may calculate as to what number times the bet number becomes the win dividend when a multiplier is applied. When the processing at S56 is finished, the process proceeds to S58.

In the processing at S58, the CPU 21 determines whether or not a win is acquired when a special event is applied, and whether or not a predetermined dividend condition is satisfied. An example of the predetermined dividend condition is that the won dividend is the bet number times a predetermined number (for example, 20 times). Further, the predetermined dividend condition may be a condition that the won dividend exceeds a predetermined amount (for example, 10,000 credit). As described above, the CPU 21 determines whether to apply the special event before stop of the reel spin, or apply the special event after stop of the reel spin, based on the dividend at the time when the special event is applied.

The CPU 21 applies the special event before stop of the reel spin, when the CPU 21 determines that no win is acquired even when the special event is applied, and when the CPU 21 determines that the predetermined dividend condition is not satisfied even when a win is acquired, based on the processing result at S56. Specifically, the CPU 21 stops the reel spin (S62), after the special event is applied (S60). With such a configuration, the player's expectations for a result of the game can be maintained until the reel spin is stopped, by providing a state advantageous to the player before stop of the reel spin, even when no win would be acquired although the special event is applied. In addition, in a case where application of the special event has a small influence such as a case where a paying ratio is equal to or less than the predetermined value, or a case where the dividend is equal to or less than the predetermined amount, this structure provides a state advantageous to the player before stop of the reel spin, and thus provides the player with expectations for a result of the game until the reel spin is stopped.

In addition, when no win is acquired even when the special event is applied or when application of the special event has a small influence on the dividend, by not applying the special event after stopping the reel spin, the structure can prevent causing a situation such that application of the special event after stopping the reel spin causes the player excessive expectations, then causing much disappointment to the player because of a failure to acquire the expected dividend as a result.

Figure 9:
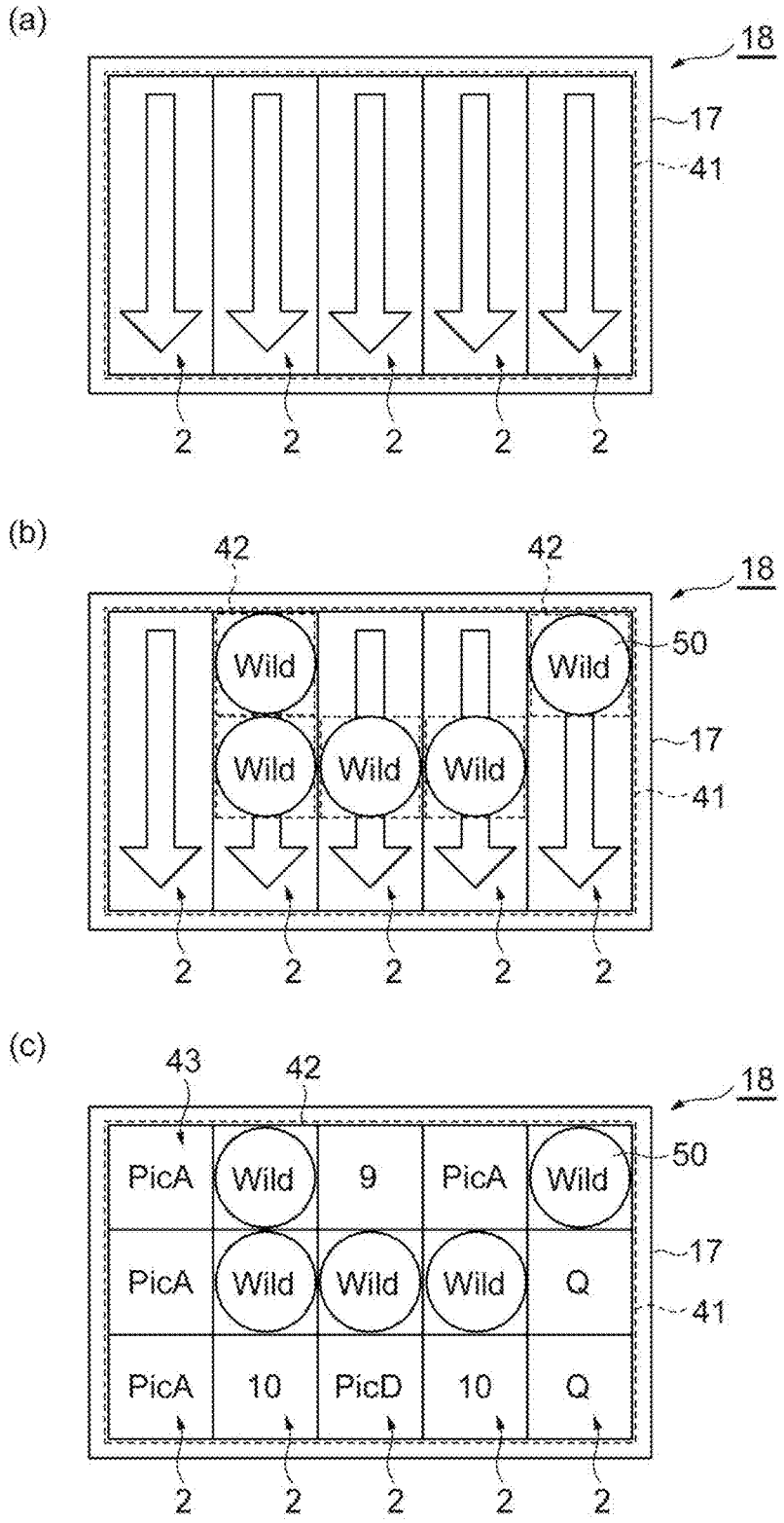
FIG. 9 illustrates an example of display transition when the special event is applied.

The following is an explanation of the processing at S60 and S62. (a) to (c) of FIG. 9 illustrate an example of display transition of the slot game in a case where the special event is applied before the reel spin is stopped. First, (a) of FIG. 9 illustrates a state where the reels 2 are spinning in the symbol region 41 before application of a special event. In this state, the symbols 43 are scrolled in each of the columns of the symbol region 41 in accordance with the arrangements of the virtual reel strips corresponding to the respective reels 2 of the symbol region 41. In FIG. 9, white arrows representing a state where the reels are spun and the symbols are scrolled. Next, (b) of FIG. 9 illustrates a state where the special event is applied during the reel spin, and wild symbols 50 are arranged on the predetermined cells 42 and occupy the cells 42. In this state, while the symbols 43 continue to scrolled in each of the columns, wild symbols 50 are superimposed and displayed on the front surface thereof. In other words, in this state, the reels 2 are spun in the rear of the wild symbols 50. The last (c) of FIG. 9 illustrates a state in which the reel spin is stopped after application of the special event, and the symbols 43 are stopped and fixed in all of the cells 42 in the symbol region 41.

In contrast, the CPU 21 applies the special event after the reel spin is stopped when a win is acquired at the time the special event is applied and the predetermined condition is satisfied, based on the processing result at S56. In other words, the CPU 21 applies the special event (S66) after the reel spin is stopped (S64). For example, the special event is applied after the reel spin is stopped, in a case where a win is acquired when the special event is applied, and when the special event has a large influence such as a case where the paying ratio is higher than a predetermined value, and a case where a dividend is larger than a predetermined amount. As described above, because the special event is applied after the reel spin is stopped, this structure causes the player to visually recognize a symbol arrangement before application of the special event by stop of the reel spin, and enables application of the special event at a stage where the player predicts that the game is finished. Therefore, this structure can provide a prize winning of a high-priced dividend in the form of exceeding the player's expectations, and enhances the player's surprise and satisfaction.

Figure 10:
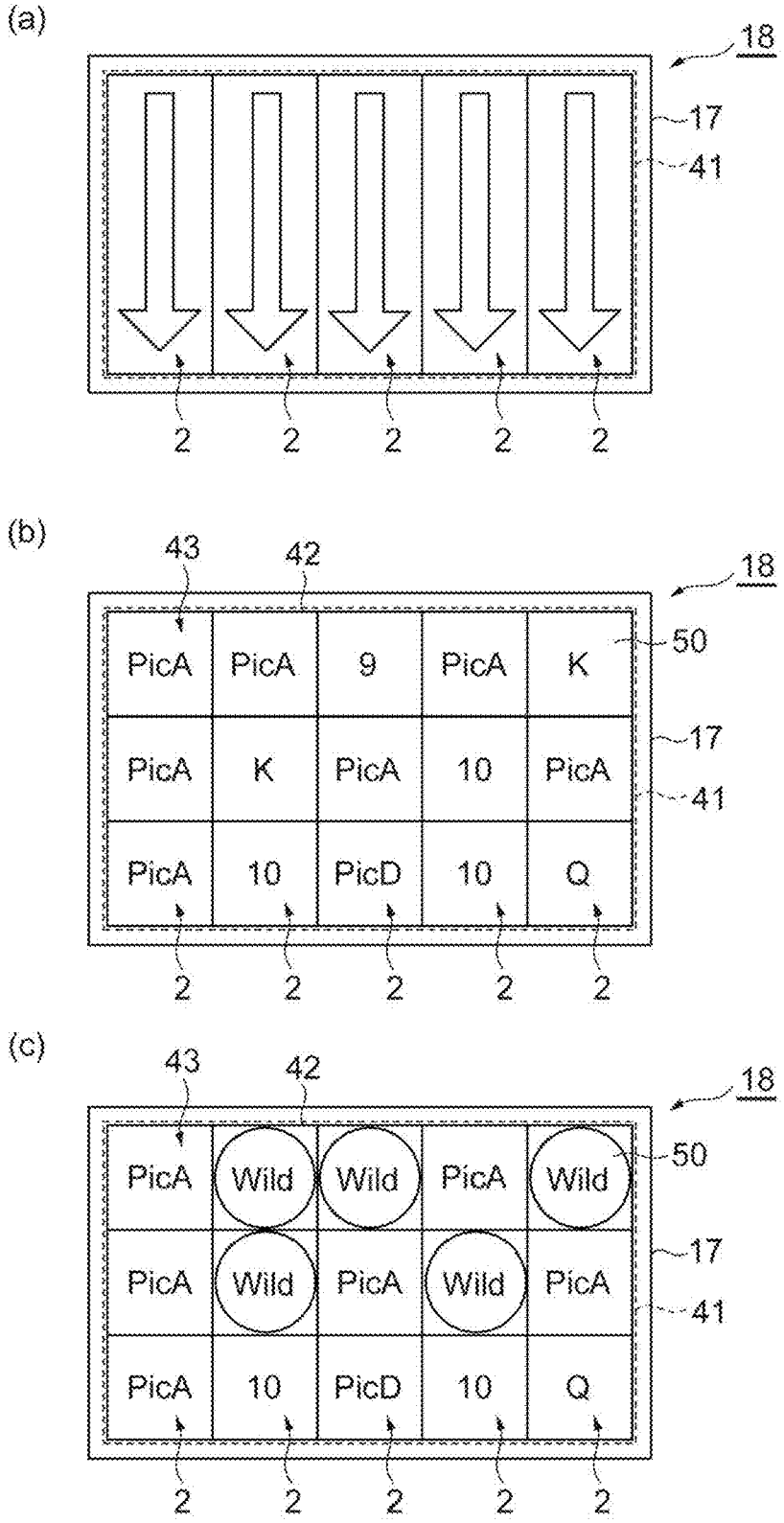
FIG. 10 illustrates an example of display transition when the special event is applied.

The following is an explanation of the processing at S64 and S66. (a) to (c) of FIG. 10 illustrate an example of display transition of the slot game in a case where the special event is applied after the reel spin is stopped. First, (a) of FIG. 10 illustrates a state where the reels 2 are spinning in the symbol region 41 before the reel spin is stopped. In this state, the symbols 43 are scrolled in each of the columns of the symbol region 41, in the same manner as (a) of FIG. 9, to represent spin of the reels. Next, (b) of FIG. 10 illustrates a state where the reel spin is stopped, and the symbols 43 to be stopped in all the cells 42 in the symbol region 41 are settled (S64). The last (c) of FIG. 10 illustrates a state in which the special event is applied in the state where the symbols 43 are stopped in all the cells 42 in (b) of FIG. 10, and wild symbols 50 are arranged on the predetermined cells 42 and superimposed on the front surfaces of the symbols 43 displayed on the cells 42.

The special event processing illustrated in FIG. 8 ends and the process returns to S16 to execute the subsequent processing if the current game is the normal game, and the process returns to S77 to execute the subsequent processing if the current game is the free game. By execution of the special event processing illustrated in FIG. 8, the special event can be effectively applied, based on the dividend at the time of application of the special event.

Figure 11:
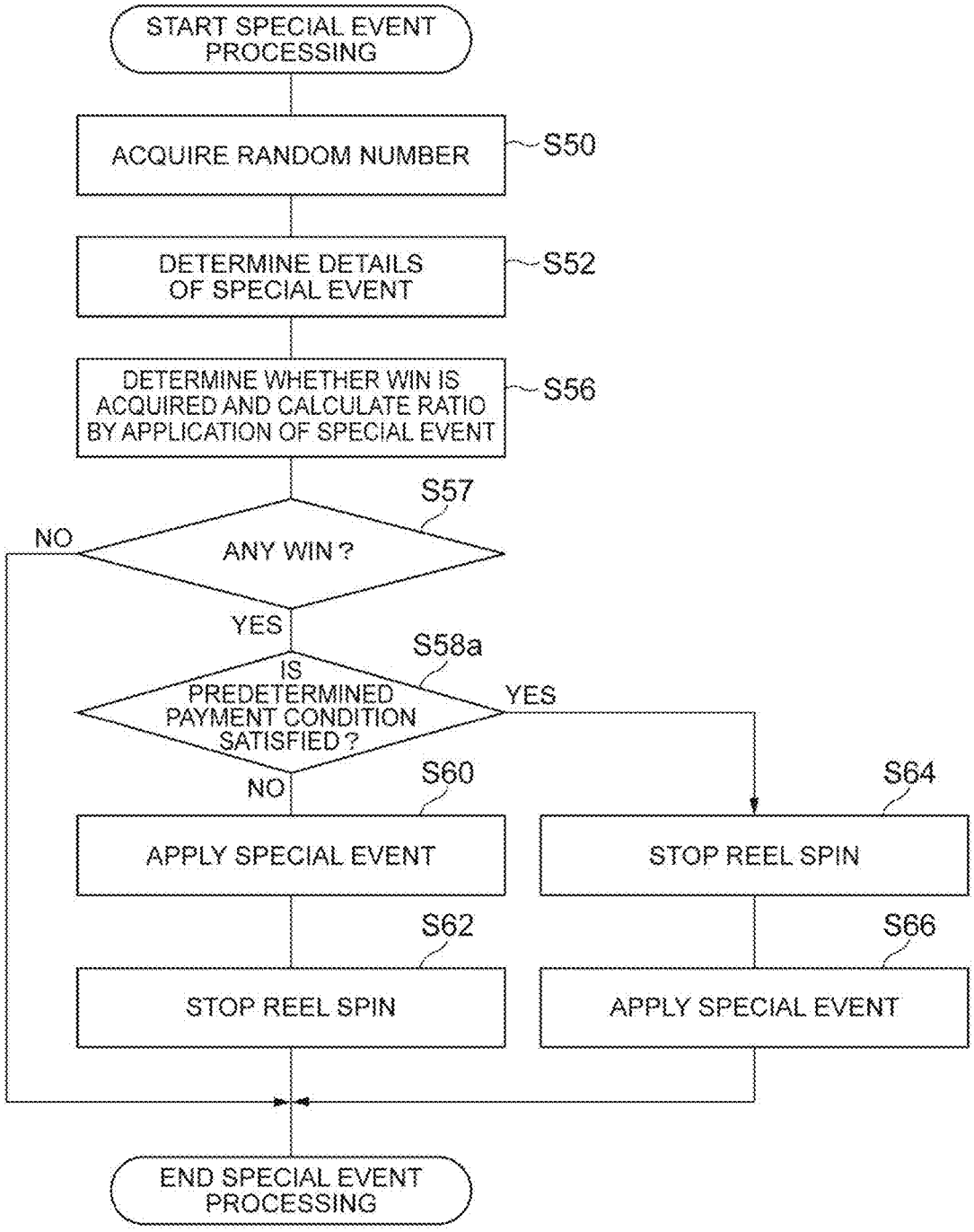
FIG. 11 is a flowchart illustrating other operations of the special event processing of the gaming machine of FIG. 1.

The following is an explanation of the outline of another example of the special event processing. FIG. 11 is a flowchart illustrating other operations to execute the special event processing by the CPU 21. Because most of the flowchart overlaps with the operations of FIG. 8, the overlapping steps are denoted by the same number, and explanation thereof is omitted. In the operations, after determination of whether or not a win is acquired by application of the special event and the ratio thereof is calculated in the same manner at S56, the CPU 21 determines whether or not a win is acquired in the processing at S57, and ends the special event processing when no win is acquired. On the other hand, when any win is acquired, the CPU 21 determines whether a predetermined dividend condition is satisfied in the processing at S58*a* in the same manner as above and the special event is applied after the reel spin is stopped if the condition is satisfied, and the special event is applied before the reel spin is stopped if the condition is not satisfied.

In the special event processing described above, the special event is applied even when no win occurs so that expectations for a result of the game is enhanced. However, there is a possibility that such processing may discourage the player's expectations for the special event, because no win occurs even when the special event is applied. For this reason, in the present special event processing, no special event is applied when no win occurs, to prevent discouraging the player's expectations for the special event.

This processing enables effective application of the special event, based on the dividend when the special event is applied, while maintaining the player's expectations for the special event.

Figure 12:
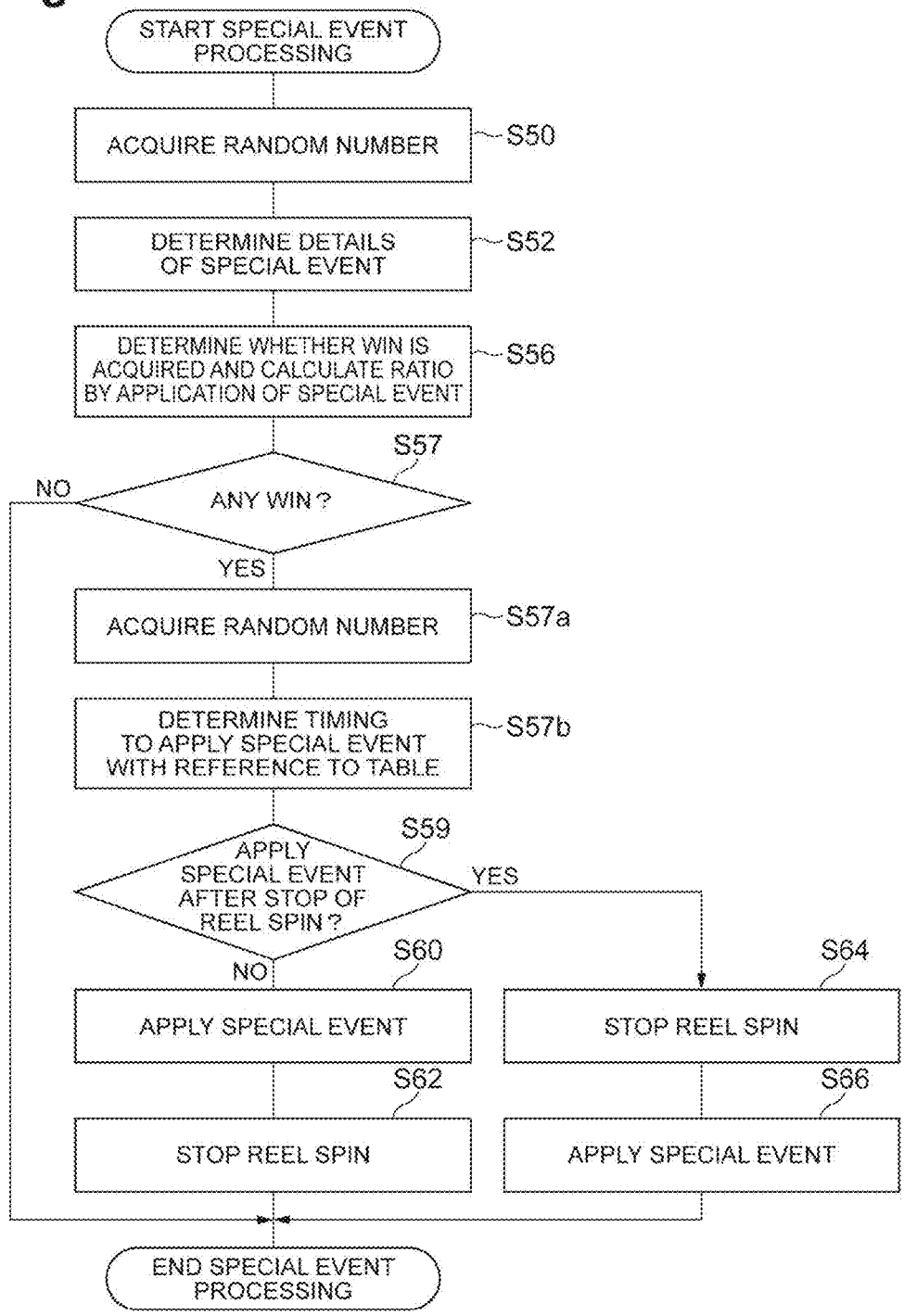
FIG. 12 is a flowchart illustrating other operations of the special event processing of the gaming machine of FIG. 1.

The following is an explanation of the outline of another example of the special event processing. FIG. 12 is a flowchart illustrating other operations to execute the special event processing by the CPU 21. Because most of the flowchart overlaps with the operations of FIG. 8 and FIG. 11, the overlapping steps are denoted by the same number, and explanation thereof is omitted. In the operations, after determination of whether or not a win is acquired by application of the special event and the ratio thereof is calculated in the same manner at S56, the CPU 21 determines whether or not a win is acquired in the processing at S57, and determines the timing to apply the special event in the processing at S57*a* and S57*b* if a win is acquired. In other words, the CPU 21 acquires a random number in the processing at S57*a*, and the CPU 21 determines the timing to apply the special event in the processing at S57*b* with reference to the table in (a) or (b) of FIG. 13. For example, the table in (a) of FIG. 13 prescribes a probability of applying the special event during the reel spin, and a probability of applying the special event after stopping the reel spin for each of the cases where the ratio (dividend/bet number) of the dividend by application of the special event is less than 5 times, equal to or more than 5 times and less than 10 times, equal to or more than 10 times and less than 20 times, and equal to or more than 20 times. At S57*b*, the timing to apply the special event is determined in accordance with the probabilities, in accordance with the value of the random number acquired at S57*a*. Additionally, the table of (b) of FIG. 13 prescribes a probability of the timing to apply the special event for each of the cases where the credit of the dividend by application of the special event is less than 2000, equal to or more than 2000 and less than 5000, equal to or more than 5000 and less than 10000, and equal to and more than 10000. Even in the case of using the table of (b) of FIG. 13, the timing to apply the special event is determined in accordance with the probabilities in the same manner.

In the previously mentioned two special event processings, the timing for applying the special event in accordance with the respective predetermined dividend conditions is determined to one, so the player who has played repeatedly can recognize the dividend in advance based on the special event application timing, and the player need not experience unexpected development. This structure may cause the player to get tired of the games, and the player cannot be expected to play the games for a long time. In contrast, in the present special event processing, the timing to apply the special event can be determined with a tendency based on the dividend by the special event. Accordingly, this structure prevents prior recognition of the dividend based on the timing to apply the special event, and leaves room for generation of unexpected development for the player. Accordingly, this structure prevents the player from getting tired of the games, and enables to expect long-time play. Further, the tables of (a) and (b) in FIG. 13 may be implemented in a proper form in the program executed by the CPU 21, or may be implemented as a data structure separated from the program. Further, the ratio of the dividend or the credit is divided into five levels, to determine the timing to apply the special event based on the probabilities provided for the respective levels in the above, but the divided levels of the ratio or the like may be greater or less than five.

Further, the function of the controller 20 described above is not limited to the gaming machine, so may be achieved by a program executed by various types of computers, such as a personal computer, a server computer, a smartphone, a tablet terminal, and a PDA. The function may also be achieved by execution of a program by distributed processing performed by a system such that a gaming machine and various computers are connected to perform communications, or a system formed by various computers that are connected to perform communications.

In other words, a program can be created to cause one or a plurality of computers to function in the same manner as the controller 20 described above. The function achieved by executing such a program is the same as that of the controller 20 described above, and the like, a function to effectively provide the special event is achieved.

The above program may be recorded and provided in a computer-readable recording medium, such as a random access memory (RAM), a read-only memory (ROM), an erasable programmable read-only memory (EPROM), a flash memory, a hard disk drive, a solid state drive, a floppy (registered trademark) disk, a flash drive, a compact disk, and a digital video disk.

With the gaming machine, the gaming method, and the recording medium according to the embodiment described above, because the timing to apply the special event is determined based on the payout when the special event is applied, this structure prevents uniformity of the timing to apply the special event. Accordingly, this structure can provide the special event at a timing that is unexpected to the player. Hence, this structure can effectively apply the special event.

Further, the present invention is not limited to the embodiment described above, but can be carried out in proper forms. For example, the number of the reels arranged in the symbol region is not limited to the example of the embodiment described above. The embodiment described above illustrates all the reels as virtual reels, but some of or all the reels may be physical reels. The embodiment described above illustrates the case of applying the special event after start of spin of the reels 2 and before stop of the spin thereof, as an example of applying the special event before stop of the reel spin, but the special event may be applied before start of spin of the reels 2. In addition, the game machine according to the embodiment is illustrated with the example such that the stop positions of the individual symbols are determined with random numbers, but the scoring combination may be determined by internal lottery, and the stop positions may be set in accordance with the combination.

Further, the special event is not limited to an event to change a result of the normal game, but may be a bonus game such as a pick game, a roulette game, and a wheel game, or another slot game.

Furthermore, the embodiment described above illustrates the case where the special event is applied at a timing based on the dividend acquired in both the normal game and the special game, but a structure may be adopted to provide the special event at the timing in only either one of the normal game and the special game, and a structure may be adopted to apply the special event in only either one of the normal game and the special game.

Furthermore, the timing to apply the special event in the embodiment described above is a timing before the reel spin is stopped or after the reel spin is stopped, but the timing to apply the special event can be properly set between start of the reel spin and stop of the reel spin to determine whether any winning pattern is formed. For example, the scope of the present invention also includes providing a plurality of timings to apply the special event between start of the reel spin to stop of the reel spin, to apply the special event at timing in accordance with the dividend to be acquired. Additionally, a structure may be adopted to dynamically calculate and determine the timing to apply the special event in accordance with the dividend to be acquired.

Furthermore, the embodiment described above illustrates the example such that the special event is applied before stop of the reel spin to provide a state advantageous to the player, when application of the special event has a small influence; an example of the case where application of the special event has a small influence may be a case where the dividend serving as an award acquired by application of the special event is equal to or less than the dividend serving as an award acquired in a case where no special event is applied, or the case where a difference between the dividend serving as the award acquired by application of the special event and the dividend serving as the award acquired in a case where no special event is applied is equal to or less than the predetermined amount. In addition, the embodiment described above illustrates the example such that the special event is applied after the reel spin is stopped when the special event has a large influence; an example of the case where the special event has a large influence may be a case where the dividend serving as the award acquired by application of the special event is larger than the dividend serving as the award acquired in a case where no special event is applied, or may be the case where a difference between the dividend serving as the award acquired by application of the special event and the dividend serving as the award acquired in a case where no special event is applied is larger than the predetermined amount.

REFERENCE SIGNS LIST

1 . . . Gaming machine, 2 . . . Reel, 18 . . . Display unit (display unit), 20 . . . Controller.

What is claimed is:

1. A gaming machine providing a game that spins a plurality of reels with each reel including a plurality of symbols and thereafter stops the reels, determines a win based on arrangement of the symbols after stop, and provides an award in accordance with a win result, the gaming machine comprising:

a display unit configured to display the game; and a controller configured to determine contents of the game to be displayed on the display unit and to determine a dividend, to be used as the award, based on the contents of the game displayed on the display unit, wherein the controller is configured to determine application of a special event when a predetermined condition is satisfied, determine a revised dividend, to be used as the award, after the application of the special event, and determine a timing to apply the special event based on the dividend and the revised dividend.

2. The gaming machine according to claim 1, wherein the controller determines whether the special event is to be applied before stop of reel spin, or after stop of the reel spin, based on the award acquired by the application of the special event.

3. The gaming machine according to claim 2, wherein the controller applies the special event before stop of reel spin when the revised dividend serving as the award acquired by the application of the special event is equal to or lower than a predetermined amount, and applies the special event after stop of the reel spin when the revised dividend serving as the award acquired by the application of the special event is higher than the predetermined amount.

4. The gaming machine according to claim 2, wherein the controller applies the special event before reel spin is stopped when the revised dividend serving as the award acquired by the application of the special event is equal to or less than the dividend serving as an award acquired in a case where no special event is applied, and applies the special event after the reel spin is stopped when the revised dividend serving as the award acquired by the application of the special event is larger than the dividend serving as the award acquired in a case where no special event is applied.

5. The gaming machine according to claim 2, wherein the controller applies the special event before reel spin is stopped when a difference between the revised dividend serving as the award acquired by the application of the special event and the dividend serving as the award acquired in a case where no special event is applied is equal to or less than a predetermined amount, and applies the special event after the reel spin is stopped when the difference between the revised dividend serving as the award acquired by the application of the special event and the dividend serving as the award acquired in a case where no special event is applied is larger than the predetermined amount.

6. A gaming machine providing a game that spins a plurality of reels with each reel including a plurality of symbols and thereafter stops the reels, determines a win based on arrangement of the symbols after stop, and provides an award in accordance with a win result, the gaming machine comprising:

a display unit configured to display the game; and a controller configured to determine contents of the game to be displayed on the display unit, wherein the controller is configured to determine application of a special event when a predetermined condition is satisfied, and to determine a timing to apply the special event based on the award acquired by the application of the special event, wherein the controller applies the special event before stop of reel spin when a dividend serving as the award acquired by the application of the special event is equal to or lower than a predetermined amount, and applies the special event after stop of the reel spin when the dividend serving as the award acquired by the application of the special event is higher than the predetermined amount.

7. A gaming machine providing a game that spins a plurality of reels with each reel including a plurality of symbols and thereafter stops the reels, determines a win based on arrangement of the symbols after stop, and provides an award in accordance with a win result, the gaming machine comprising:

a display unit configured to display the game; and a controller configured to determine contents of the game to be displayed on the display unit, wherein the controller is configured to determine application of a special event when a predetermined condition is satisfied, and to determine a timing to apply the special event based on the award acquired by the application of the special event, wherein the controller applies the special event before reel spin is stopped when a dividend serving as the award acquired by the application of the special event is equal to or less than the dividend serving as an award acquired in a case where no special event is applied, and applies the special event after the reel spin is stopped when the dividend serving as the award acquired by the application of the special event is larger than the dividend serving as the award acquired in a case where no special event is applied.

8. A gaming machine providing a game that spins a plurality of reels with each reel including a plurality of symbols and thereafter stops the reels, determines a win based on arrangement of the symbols after stop, and provides an award in accordance with a win result, the gaming machine comprising:

a display unit configured to display the game; and a controller configured to determine contents of the game to be displayed on the display unit, wherein the controller is configured to determine application of a special event when a predetermined condition is satisfied, and to determine a timing to apply the special event based on the award acquired by the application of the special event, wherein the controller applies the special event before reel spin is stopped when a difference between a dividend serving as the award acquired by the application of the special event and the dividend serving as the award acquired in a case where no special event is applied is equal to or less than a predetermined amount, and applies the special event after the reel spin is stopped when the difference between the dividend serving as the award acquired by the application of the special event and the dividend serving as the award acquired in a case where no special event is applied is larger than the predetermined amount.

9. A gaming method by which a display unit displays a game that spins a plurality of reels with each reel including a plurality of symbols and thereafter stops the reels, determines a win based on arrangement of the symbols after stop, and a controller determines a win based on arrangement of the symbols after stop and provides an award in accordance with a win result, the method comprising a step of:

determining, by the controller, contents of the game to be displayed on the display unit, determining, by the controller, a dividend, to be used as the award, based on the contents of the games displayed on the display unit, determining, by the controller, application of a special event when a predetermined condition is satisfied, determining, by the controller, a revised dividend, to be used as the award, after the application of the special event, and determining, by the controller, a timing to apply the special event based on the dividend and the revised dividend.

10. A non-transitory computer-readable recording medium recording a program to cause one or a plurality of computers to implement a function of providing a player with a game that spins a plurality of reels with each reel including a plurality of symbols and thereafter stops the reels, determines a win based on arrangement of symbols after stop, and provides an award in accordance with a win result, the program causing the one or plurality of computers to function as a controller determining contents of the game to be displayed on a display unit, wherein the controller is configured to determine contents of the game to be displayed on the display unit, determine a dividend, to be used as the award, based on the contents of the games displayed on the display unit, determine application of a special event when a predetermined condition is satisfied, determine a revised dividend, to be used as the award, after the application of the special event, and determine a timing to apply the special event based on the dividend and the revised dividend.

11. A gaming method by which a display unit displays a game that spins a plurality of reels with each reel including a plurality of symbols and thereafter stops the reels, determines a win based on arrangement of the symbols after stop, and a controller determines contents of the game to be displayed on the display unit and provides an award in accordance with determined contents, the method comprising a step of:

determining, by the controller, application of a special event exerting influence on the award when a predetermined condition is satisfied, and determining, by the controller, a timing to apply the special event based on the award acquired by the application of the special event, wherein the special event is applied before stop of reel spin when a dividend serving as the award acquired by the application of the special event is equal to or lower than a predetermined amount, and the special event is applied after stop of the reel spin when the dividend serving as the award acquired by the application of the special event is higher than the predetermined amount.

12. A gaming method by which a display unit displays a game that spins a plurality of reels with each reel including a plurality of symbols and thereafter stops the reels, determines a win based on arrangement of the symbols after stop, and a controller determines contents of the game to be displayed on the display unit and provides an award in accordance with determined contents, the method comprising a step of:

determining, by the controller, application of a special event exerting influence on the award when a predetermined condition is satisfied, and determining, by the controller, a timing to apply the special event based on the award acquired by the application of the special event, wherein the special event is applied before reel spin is stopped when a dividend serving as the award acquired by the application of the special event is equal to or less than the dividend serving as an award acquired in a case where no special event is applied, and the special event is applied after the reel spin is stopped when the dividend serving as the award acquired by the application of the special event is larger than the dividend serving as the award acquired in a case where no special event is applied.

13. A gaming method by which a display unit displays a game that spins a plurality of reels with each reel including a plurality of symbols and thereafter stops the reels, determines a win based on arrangement of the symbols after stop, and a controller determines contents of the game to be displayed on the display unit and provides an award in accordance with determined contents, the method comprising a step of:

determining, by the controller, application of a special event exerting influence on the award when a predetermined condition is satisfied, and determining, by the controller, a timing to apply the special event based on the award acquired by the application of the special event, wherein the special event is applied before reel spin is stopped when a difference between a dividend serving as the award acquired by the application of the special event and the dividend serving as the award acquired in a case where no special event is applied is equal to or less than a predetermined amount, and the special event is applied after the reel spin is stopped when the difference between the dividend serving as the award acquired by the application of the special event and the dividend serving as the award acquired in a case where no special event is applied is larger than the predetermined amount.

14. A non-transitory computer-readable recording medium recording a program to cause one or a plurality of computers to implement a function of providing a player with a game that spins a plurality of reels with each reel including a plurality of symbols and thereafter stops the reels, determines a win based on arrangement of symbols after stop, and provides an award in accordance with a win result, the program causing the one or plurality of computers to function as a controller determining contents of the game to be displayed on a display unit, wherein the controller is configured to determine application of a special event exerting influence on the award when a predetermined condition is satisfied, and determine a timing to apply the special event based on the award acquired by the application of the special event, wherein the special event is applied before stop of reel spin when a dividend serving as the award acquired by the application of the special event is equal to or lower than a predetermined amount, and the special event is applied after stop of the reel spin when the dividend serving as the award acquired by the application of the special event is higher than the predetermined amount.

15. A non-transitory computer-readable recording medium recording a program to cause one or a plurality of computers to implement a function of providing a player with a game that spins a plurality of reels with each reel including a plurality of symbols and thereafter stops the reels, determines a win based on arrangement of symbols after stop, and provides an award in accordance with a win result, the program causing the one or plurality of computers to function as a controller determining contents of the game to be displayed on a display unit, wherein the controller is configured to determine application of a special event exerting influence on the award when a predetermined condition is satisfied, and determine a timing to apply the special event based on the award acquired by the application of the special event, wherein the controller applies the special event before reel spin is stopped when a dividend serving as the award acquired by the application of the special event is equal to or less than the dividend serving as an award acquired in a case where no special event is applied, and applies the special event after the reel spin is stopped when the dividend serving as the award acquired by the application of the special event is larger than the dividend serving as the award acquired in a case where no special event is applied.

16. A non-transitory computer-readable recording medium recording a program to cause one or a plurality of computers to implement a function of providing a player with a game that spins a plurality of reels with each reel including a plurality of symbols and thereafter stops the reels, determines a win based on arrangement of symbols after stop, and provides an award in accordance with a win result, the program causing the one or plurality of computers to function as a controller determining contents of the game to be displayed on a display unit, wherein the controller is configured to determine application of a special event exerting influence on the award when a predetermined condition is satisfied, and determine a timing to apply the special event based on the award acquired by the application of the special event, wherein the controller applies the special event before reel spin is stopped when a difference between a dividend serving as the award acquired by the application of the special event and the dividend serving as the award acquired in a case where no special event is applied is equal to or less than a predetermined amount, and applies the special event after the reel spin is stopped when the difference between the dividend serving as the award acquired by the application of the special event and the dividend serving as the award acquired in a case where no special event is applied is larger than the predetermined amount.

* * * * *